United States Patent [19]

Tayebi

[11] Patent Number: 4,945,907

[45] Date of Patent: Aug. 7, 1990

[54] FACE MASK

[75] Inventor: Amad Tayebi, Westford, Mass.

[73] Assignee: New England Thermoplastics, Inc., Lawrence, Mass.

[21] Appl. No.: 260,593

[22] Filed: Oct. 21, 1988

Related U.S. Application Data

[62] Division of Ser. No. 41,001, Apr. 13, 1987, Pat. No. 4,856,508.

[51] Int. Cl.[5] ..... A62B 7/10

[52] U.S. Cl. ..... 128/206.12; 128/206.15; 128/206.17; 128/206.28

[58] Field of Search ..... 128/206.12, 206.15, 128/206.17, 206.25, 207.11, 207.12, 206.28

[56] References Cited

U.S. PATENT DOCUMENTS

| | | | |
|---|---|---|---|
| 1,925,764 | 9/1933 | Le Duc | 128/206.12 |
| 2,067,026 | 1/1937 | Schwartz | 128/206.12 |
| 2,681,060 | 6/1954 | Swindell | 128/206.12 |
| 3,276,445 | 10/1966 | Langdon | 128/206.15 |
| 3,521,630 | 7/1970 | Westberg et al. | 128/206.15 |
| 3,861,381 | 1/1975 | Witman et al. | 128/206.12 |
| 4,002,167 | 1/1977 | Ramhosck | 128/206.24 |
| 4,266,301 | 5/1981 | Canda | 2/6 |
| 4,347,205 | 8/1982 | Stewart | 264/130 |
| 4,361,146 | 11/1982 | Woicke | 128/206.12 |
| 4,454,881 | 6/1984 | Huber et al. | 128/206.15 |
| 4,619,948 | 10/1986 | Kennedy et al. | 264/45.3 X |
| 4,641,645 | 2/1987 | Tayebi | 128/206.24 X |
| 4,688,567 | 8/1987 | Kikuchi et al. | 128/206.17 X |

FOREIGN PATENT DOCUMENTS

| | | | |
|---|---|---|---|
| 3434357 | 3/1986 | Fed. Rep. of Germany | 128/206.12 |
| 2176404 | 12/1986 | United Kingdom | 128/206.12 |

*Primary Examiner*—Robert A. Hafer
*Assistant Examiner*—Kevin G. Rooney
*Attorney, Agent, or Firm*—Joseph E. Funk

[57] ABSTRACT

A reusable face mask is disclosed that filters particulate matter and noxious and poisonous gasses from breathed air. The face mask has a mask shell that is thermoformed of cross-linked, closed cell foam sheet that is impermeable to air while having good shape retention and elasticity. The mask shell is perforated with multiple holes in its central area to permit inhaled air to pass through the otherwise impermeable shell. The mask shell is stiff enough to support filter mounting apparatus that has an internal potion and an external portion that both cover the multiple holes. Filters made from filter sheet material and having a self-adhesive strip around their periphery are removably attached to the mounting apparatus to filter breathed air. Neither the mounting apparatus nor the filters ever touch the face of the wearer of the face mask. By using two filters, selective combinations of noxious and poisonous gasses, dusts and mists may be filtered from breathed air.

6 Claims, 4 Drawing Sheets

FACE MASK

This is a division of application Ser. No. 041,001, filed Apr. 13, 1987 now U.S. Pat. No. 4,856,508.

Field of the Invention

The present invention relates to face masks that cover the nose and mouth while filtering breathed air and, in particular, face masks having a molded or thermoformed, non-porous or porous shells, and replaceable filter lines that may be impregnated with a substance to remove noxious or other material including gasses from the breathed air.

BACKGROUND OF THE INVENTION

Examination of the prior art yields a variety of face masks or respirators for treatment of breathed air. Generally, the masks of the prior art may be categorized into one of two classes, namely; disposable or single-use respirators and replaceable cartridge respirators.

In general, disposable masks of the prior art are made of a permeable fibrous media formed into a cup shape to fit the contour of the face of the wearer. In some masks the fibrous media is formed to fit the face of the wearer and, simultaneously, achieves a seal against the flow of toxic dusts and mists into the breathed air chamber. In other masks a nose clip is attached to the face mask and is utilized to achieve a seal around the nose area.

In the majority of disposable fibrous media masks of the prior art, breathed air treatment and filtration is achieved by air flow through most of the area of the face mask. Although this is relatively costly, since a large amount of filtration media is used to fabricate the entire mask shell in addition to the excessive between-shell cut-out waste, it is advantageous since it results in a relatively lower pressure drop across the filtration media for the same breathed air volume flow rate. Those masks still have a limited capacity and lack the ability to carry a sufficient charge of air treatment substances for the absorption of toxic gasses, fumes, vapors, etcetera in order to provide the wearer with protection in harmful environments. Thus, such disposable face masks cannot meet standards or requirements for governmental approval in such applications. For example, it is difficult to impregnate the disposable face mask fibrous media with a sufficient charge of activated charcoal granules (approximately 100 grams) to pass government requirements for paint spray, organic vapor, acid gas or pesticide applications. This is due to the limited capacity of the fibrous media for encapsulating or for being loaded or impregnated with toxic gas treatment media. In certain instances, even when a relatively thicker fibrous shell is used, the amount of charcoal encapsulated in the mask shell is insufficient for meeting the National Institute for Occupational Safety and Health (NIOSH) requirements for certification or approval for paint spray applications. In such cases the resulting mask, lacking NIOSH approval, is usually referred to as a nuisance mask.

In many cases, however, where the filtration media is impregnated with air treatment substances or is loaded with additional fibrous media, the face mask is relatively thicker and a good face-mask fit and seal are much harder to achieve. In these cases a nose clip and/or wide, low extensibility heavy duty straps are used in order to apply a high force to pull the mask against the face of the wearer. As a result, the air seal is obtained by deforming the wearer's face to conform to the perimeter of the mask, rather than deforming the mask to conform to the face of the wearer. Needless to say, such a mask is not comfortable to wear.

Therefore, a limiting factor in making single use respirators that meet NIOSH requirements is that it is very difficult to produce a fibrous media mask carrying a weight of approximately 100 grams of activated charcoal granules while maintaining the total mass of the mask within bearable limits.

Examination of prior art masks shows that the formation of the majority of disposable masks involves heating, stretching and/or compressive compaction of the filtration media. Such processing factors may adversely influence the effectiveness of the filtration media with regard to its filtration efficiency and pressure drop. The examination also shows that, in the majority of disposable masks, the area of contact with the face of the wearer is of a fibrous nature and thus cannot provide an airtight seal similar to an elastomeric material seal is required by regulatory agencies for certain applications against toxic gasses and vapors.

In the manufacture of respirators designed for single use or for a finite period use, a significant portion of the overall product cost is the cost of the filtration media. As the cost of media (including cut out waste) increases, the competetiveness of the overall product in the marketplace suffers significantly. This typically true in all face masks targeted to the particulate filtration applications, including toxic dusts and mists. In the majority of such masks the area of filtration media in the final product is equal to the area of the mask shell.

In the prior art, numerous products and patents are directed towards obtaining an effective air-tight seal between the perimeter of the mask shell and the face of a wearer. In certain instances a polymeric bead, rim, flap, or their combinations are added at the perimeter of the fibrous shell face mask. Except for use of a thin rim of impermeable closed cell elastomeric material or foam around the perimeter of the face mask in the zone in contact with the face of the wearer, examination of prior art masks and patents has shown no suggestion or use of impermeable polymeric foam materials in the basic shell comprising the body of face masks.

On the other hand, replaceable cartridge masks of the prior art are generally comprised of an elastomeric face piece designed to fit the face of the wearer and achieve an air-tight seal with the face of the wearer. The elastomeric face piece is usually fitted with at least one opening to receive a detachably attached cartridge for treatment of the breathed air. The elastomeric face piece is also usually fitted with a one-way exhalation valve.

In order to achieve and maintain an air-tight seal around the perimeter of a cartridge, the mask shell is stiffened either through ribbing or through the use of increased material thickness, particularly around the cartridge receiving opening. Hence, the face mask is generally made of a heavy construction and thus feels heavy on the face of the wearer. As an example, a replaceable cartridge mask of the prior art was weighted and yielded the following data. The total weight of the basic face mask shell with mounting straps and two replaceable activated charcoal granule filters is 327 grams. The weight of the two filter cartridges is 183 grams. The ratio of the weight of the mask functional components (filters) to the total mask weight, $R=182/327=0.56$.

From a mask wearer's comfort standpoint, while a mask is performing its intended function, it may be concluded that it is desirable to maintain the ratio R as high as possible, particularly for masks requiring relatively heavy functional components (filters). In such cases, as R approaches its limit value of 1, the wearer's discomfort is minimized.

Generally speaking, however, NIOSH approved masks which utilize detachable attached, replaceable cartridges are costly since a sizable initial capital investment has to be made for the durable face mask shell. Other indirect costs include the cost of periodic shell cleaning, sanitization, testing for cuts, cracks, leakage, etcetera and storage. In certain work places individuals using such durable face masks prefer or require that no other co-worker may use the same face mask shell at any other time. This is usually done for the prevention of transmittal of communicable diseases through breathing contaminated air or through skin or saliva contact with a contaminated mask shell. In this case certain face mask shells are numbered and designated for use only by certain individuals.

Also, most durable masks, particularly approved ones, require a high force to pull them against the face of a wearer in order to achieve an effective seal with the face of the wearer. When such masks are made of a heavy duty construction the need also arises for head-top band in order to prevent the mask from falling off the face of the wearer and to maintain a complete seal with the face of the wearer. Such head-top band is usually branched off the above-the-ear band and is placed on top of the head of the wearer of the mask. Such a head-top band is particularly undesirable when the wearer's head top is bald at the location of the head-top band.

As may be concluded from the above, there is a need in the art of an inexpensive, flexible shell that is light weight, single-user (single or repeated use) face mask which fits around and achieves a completer air tight seal with the face of the wearer. Such a mask should have a fit and seal that are comparable to the fit and seal obtained with presently available elastomeric face pieces, while feeling light and thus relatively more comfortable, and being able to carry a charge of air treatment or filtration media and/or devices sufficient to perform the desired protection against specific environmental hazards.

The needs of the prior art are met by the face mask taught and claimed herein. The novel mask bridges the gap between unapproved disposable masks and expensive, approved replaceable cartridge respirators. This mask features a reduced cost face mask and replaceable filter arrangement in which filters made of a piece of sheet filter material and having a self adhesive strip around the edge are utilized. The face mask has a mask shell fabricated of air impermeable foam with a hole through its front and has a plastic frame mounted over the hole. The plastic frame has a portion interior to the mask shell and another portion exterior to the mask shell. The self adhesive filters are attached to either or both the interior and exterior portion of the plastic frame to filter inhaled air without contacting the face of the wearer of the face mask. In this manner a combination of filters may be selected depending on the environment in which the face mask is used.

SUMMARY OF THE INVENTION

The above needs of the prior art are met by the present novel face mask which is non-disposable which filters particulate matter, noxious and poisonous gasses from inhaled air, which is of relatively light weight, which is soft and flexible and forms a good seal to a wearers face around the nose and mouth without the need for tight elastic straps, which does not deform the face of the wearer to accomplish a good seal, which is comfortable to wear for extended periods of time, and which is relatively inexpensive. Such a face mask is a viable alternative to prior art rubber shell masks so that each worker may have their own reusable mask.

The primary embodiment of the novel mask has an outer shell that is thermoformed of cross-linked, closed-cell foam sheet. The foam shell is impermeable to air while being soft and flexible, and having good shape retention and elasticity. The center area of the shell is perforated with multiple holes to permit inhaled air to pass through the otherwise air impermeable shell and through the filter liner(s) positioned inside or outside the mask over the holes. This mask shall is stiff enough to support a variety of filter liners, either singly or in combination, ranging from a simple fibrous filter liner for filtering dust or mist, to an activated charcoal impregnated fibrous sheet liner for filtering noxious and poisonous gasses and other dangerous materials. The filter liners are removable and are attached to the inside and or outside of the shell by self adhesive strips around the periphery of the filter liner. The filter liners may also be thermobonded or otherwise permanently bonded to the inside or When filter liners are attached to both the inside and to the outside of the shell over the holes, the outer liner serves as a pre-filter, and the inner liner serves as a post-filter.

A one-way exhaust valve may be mounted through the wall of the foam mask shell to vent exhaled air. The exhaust valve is located in a position where it does not interfere with the filter liner(s).

DESCRIPTION OF THE DRAWING

The present invention will be better understood upon reading the following detailed description in conjunction with the drawing in which.

DETAILED DESCRIPTION

Figure 1:
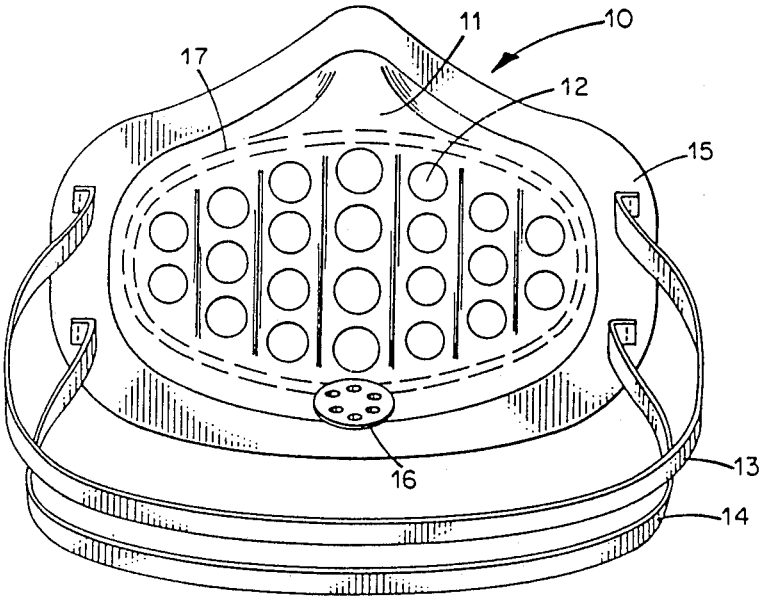
FIG. 1 is a front view of a mask having only one filter which is mounted on the inside of the mask, showing a plurality of holes through which inhaled air passes, showing the exhaled air exhaust valve, and the elastic straps that hold the mask to the face of a wearer.

In accordance with the present invention it is advantageous to use an impermeable polymeric foam as the basic face mask shell. Use of such foam, having a significantly lower density results in a generally lower weight mask, as well as a highly desirable higher filter media weight to total mask weight ratio R. Such a high ratio is not only desirable from a comfort standpoint, but also from a cost and overall weight savings, particularly for military gas masks.

For the purpose of describing the present invention an impermeable polymeric foam shall be defined as a medium which is impermeable to the flow of gasses and liquids and having a mass density lower than the product of the standard mass density of water (62.4 $lbm/ft^3$) and the specific gravity of the solid consistency of the polymer or combination of polymers from which the mask shell medium is made. For example, an impermeable polyethylene foam shall have a density lower than 62.4 $lbm/ft^3 \times 0.91 = 56.784$ $lbm/ft^3$ and, likewise, a nylon 66 foam shall have a density lower than 62.4 $lbm/ft^3 \times 1.14 = 71.136$ $lbm/ft^3$, and so on. In accordance with the above definition, an initially permeable fibrous sheet or open cell foam sheet coated or sealed on one or both sides in order to be impermeable to the flow of fluids may be defined as an impermeable foam. Other materials that may alternatively be used to make the subject mask shell are combinations or laminates of polymeric sheets or films, fibrous webs, fabrics, open cell foams and/or closed cell foams.

Due to the lower density of the foam it is possible to form thick, yet light face mask shells. This is particularly desirable since a thicker shell offers a greater overall stiffness that enables the mask shell to retain its shape while being able to carry a large mass of filtration or air treatment media without sacrificing on the ease of surface deformability of the shell. This is a feature that is essential for an effective face fit and seal. As an example, a ⅛ inch thickness lightly cross-linked closed cell, polyethylene foam, made by Voltek, with a density of 2 $lbm/ft^3$ was formed into a cup shape shell-like face mask of the type disclosed in U.S. Pat. No. 4,641,645. The formed foam shell, weighing about three grams, was attached to two extensible light duty ¼ inch width braided elastic straps weighing about two grams (commonly used for light weight face masks). This basic shell was able to carry a load of 150 grams exterior to its surface and, alternatively, interior to its surface without collapsing, falling off the wearer's face, or losing the air tight seal between its perimeter and the face of the wearer. The resulting mask has an R ratio $150/(150+2+3)=0.97$ and was more comfortable to wear for a longer period of time than the generally heavier approved masks. Further, it did not require a head-top strap as do the majority of approved masks. Generally, an activated charcoal granule charge and other media weighing a total of approximately one-hundred grams are sufficient for providing the mask wearer with protection against a variety of toxic gasses, vapors, etcetera, in accordance with NIOSH requirements.

It is worth noting from an economics standpoint and from a wearer's comfort viewpoint, that it is more desirable to use narrower and lighter, more extensible bands to hold a mask to the face. This is all possible with the present invention.

In comparison to a continuous uniform phase polymeric material, a polymeric foam shell is easier to cut and perforate. Thus, it is possible to obtain a shell with a good face seal while utilizing easier and lower capital equipment fabrication techniques such as thermoforming. The cutting and/or perforating process may be performed on formed foam mask shells obtained by thermoforming, injection molding, rotational molding, blow molding or any other fabrication technique. Although it is equally functional to use a plurality of perforations or a single large cutout, it is preferable to use a plurality of perforations. This is particularly advantageous for minimization of unsupported filtration media outwardly bulging or inwardly retracting during exhalation and inhalation and for obtaining better shape retention and support of load interior and/or exterior of the mask shell, a well as additional points within the filtration area for anchoring the media without blocking of air passage. Such anchoring points help maintain the shape of the filtration media even when the interior of the mask is highly humid of when such media is wetted by such high humidity. The feature of shape retention and resistance to collapsing in the wet condition is highly desirable and in certain cases is required for certain applications.

The use of foam for the inner and/or outer surfaces of the shell also provides a flexible surface. Such flexibility of the inner and/or outer surface offers the additional advantage of providing a conformable surface for obtaining a complete seal between a replaceable cartridge, or media liner and the shell of the mask.

In accordance with the present invention, impermeable laminates comprising at least one layer of polymeric foam material may be used for fabrication of the mask shell. Use of such laminates makes it possible to obtain combinations of colors, softness and/or high tack of the side of the mask shell in contact with the face of the wearer and firmness of the outer shell while maintaining the low weight of the entire mask shell and Food and Drug Administration (FDA) approved and unapproved materials. Such laminates also make it possible to reduce the overall material and/or fabrication costs and enhance the elastic recovery from deformation, strength and mechanical properties of the mask shell, particularly at the fixation or threading points or the strap holes.

The foam density may be as low as 4 $oz/ft^3$. Experiments conducted on lightly cross-linked polyethylene foam mask shells with a variety of densities yielded a preferred (although not necessarily optimum) density of 4 $lb/ft^3$. The use of elastomeric polymeric foam makes it possible to simultaneously obtain a desired combination of wearer's comfort, product competetivness in the market place, and mask functional features not possible with any of the prior art masks. For example: (1) clinging to the skin of the wearer's face at the perimeter of contact of the mask with the face of the wearer, thus ensuring an air-tight seal as effective as that obtained from conventional uniform solid phase elastomeric or rubber face pieces; (2) softness of contact force between the wearer's face and the mask shell, since the ease of deformity of the foam results in spreading of the force of applied pull onto the mask shell over a larger surface area of the wearer's face, thereby eliminating the harsh or excessive loading points on the wearer's face which usually cause redness on the wearer's face after even a short duration of wearing the mask; (3) lightness of shell yielding improved wearer's comfort and increase of the ratio R of weight of the filter media to the total weight of the mask. Increasing this ratio also reduces the overall material cost of the mask and enhances its competetiveness in the marketplace. It also makes it equally attractive, from a product costing standpoint, to use such foam mask shells for nuisance masks (unapproved) and NIOSH approved applications. The lightness of the shell makes it possible to use narrower, lighter, more readily extensible bands for holding the mask shell onto the face of the wearer without excessive force and preferably without a head-top band; (4) obtaining a stiff, yet light mask shell able to carry a mass of filtration and/or air treatment media sufficient to meet NIOSH approval for certain applications; and (5) enhancing the shape retention and recovery from deformation by using elastomeric material foams such as polyurethane or lightly cross-linked polyethylene, and satisfying NIOSH requirements for elastomeric face pieces for certain applications, and other desireable features as described in this application.

The mask of the present invention features a face piece covering mouth and nose of a wearer and generally conforming to the contour of the face of the wearer in the zone of contact between the face of the wearer and the face piece. In addition, the mask has a rear portion made of impermeable material, preferably closed cell polymeric foam or generally impermeable polymeric foam. The rear portion has a circumferential zone which is in contact with the face of the wearer. This zone is impermeable to air and is made of flexible, soft, high-tack, generally elastomeric material in order to provide an air-tight and complete seal between the face of the wearer and the entire circumferential zone. For lower fabrication costs the circumferential zone may be an integral part of the rear portion. It may also be an added segment attached to the side of the rear portion facing the wearer's face.

There is also a front portion made of impermeable material preferably closed cell polymeric foam or generally impermeable polymeric foam. For lower fabrication costs the front portion and the rear portion may be integral parts of one continuous impermeable shell formed of polymeric closed cell foam or generally impermeable polymeric foam, light impermeable polymeric material or laminates of foams and/or other polymeric materials. The front portion may also be attached to the rear portion in a manner that provides a complete and continuous air tight seal in the zone joining the front portion to the rear portion.

The front portion has at least one circumferential zone on its interior surface facing the face of the wearer and/or on its exterior surface. The front portion is made permeable to the passage of air, gases, particulates, vapors, etcetera by having a single large cutout area or preferably a plurality of smaller cutout areas, holes or perforations surrounded by the circumferential zone(s).

At least one air permeable treatment medium, such as a liner, plurality of liners or replaceable or permanently attached cartridge is attached to the interior and/or the exterior of the front portion in an air-tight manner along the circumferential zone, thereby creating a treated air chamber enclosed between the interior surface of the air treatment medium, the interior surface of the front portion, the interior surface of the rear portion and the face of the wearer.

For the case where more than one air permeable treatment medium are used, the first medium may be attached to the exterior of the front portion and would thereby act as a pre-treatment or initial pre-filtration medium. Such is the case for applications such as paint spray masks and the like.

The air permeable treatment medium may be attached to the outer portion signularly or in combinations, in one location or in a plurality of locations, mechanically, frictionally, by a tight fit, by a snap fit, adhesively or cohesively (i.e. by interfacial melting or fusion and cosolidification), permanently or detachably.

The outer portion may be shaped to accomodate a permeable liner, a cartridge or a plurality of cartridges and/or liners for treatment of breathed air in one location or in a plurality of locations. The lines or cartridges may treat the breathed air in series or in parallel. Further, the outer portion may be bellows shaped in order to accomodate cartridges of various thicknesses.

Figure 3:
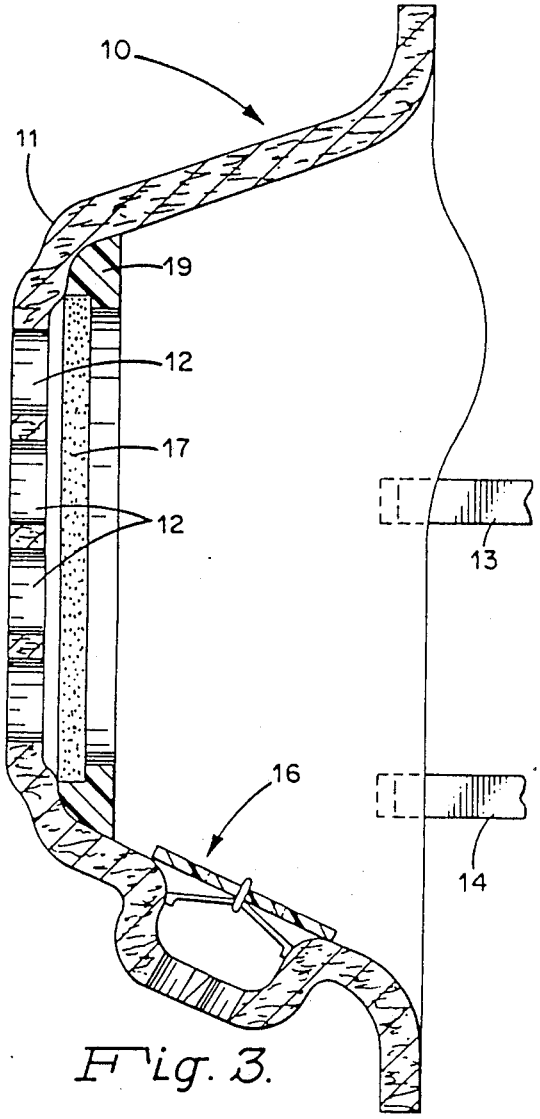
FIG. 3 is a side cross-sectional view of the masks that have inside and/or external filters showing the orientation of the inside mounted filter media, a filter retainer, and an exhaust valve.

In FIG. 1 is shown a front view of a face mask 10 which has only an internal filter liner. The mask comprises an outer shell 11 which is thermoformed from a single-layer sheet of cross-linked, closed-cell foam that is impermeable to air. Many foam materials may be used but in the embodiment of the invention disclosed herein three-sixteenths inch thick foam available from Voltek, a division of United Foam Corporation, is utilized. This foam material is soft but is thick enough that the thermoformed shell has good elastic properties yet is stiff enough that it has good shape retention and can support a filter liner and retainer therein behind holes 12 as shown in FIG. 3. The holes 12 through the central portion of the mask shell 11 may be punched through the foam sheet prior to the thermoforming of mask shell 11, or may be punched after shell 11 is formed. Holes 12 are preferably one-quarter inch diameter and the spacing between the holes is preferably one half the diameter of the holes, but one skilled in the art may vary the diameter and spacing of the holes.

Mask shell 11 also has two elastic straps 13 and 14 attached thereto on rim 15. Straps 13 and 14 go behind the head of a wearer of mask 10 when the mask is worn and hold mask 10 comfortably to the wearer's face without deforming the face while maintaining an air-tight seal between the rim 15 of mask shell 11 and the face of the wearer. The straps 13 and 14 are stapled to rim 15 in the preferred embodiment of the invention, but may also be sewn, thermobonded or adhesively attached thereto in a manner well known in the art. Although straps 13 and 14 are shown as single pieces of elastic material, in an alternative embodiment of the invention straps 13 and 14 may be made adjustable in a manner well known in the art.

In FIG. 1 is also shown a one-way exhaust valve 16 of a type known and used extensively in the face mask art. Valve 16 is mounted in a hole or a suitably shaped cavity (FIGS. 2 and 3) through the lower portion of mask shell 11 so as not to interfere with a filter liner (not shown) inside the mask 10 behind all of holes 12. Valve 16 permits a wearer of the mask to inhale through the filter liner but on exhalation valve 16 opens to vent exhaled air.

Figure 4:
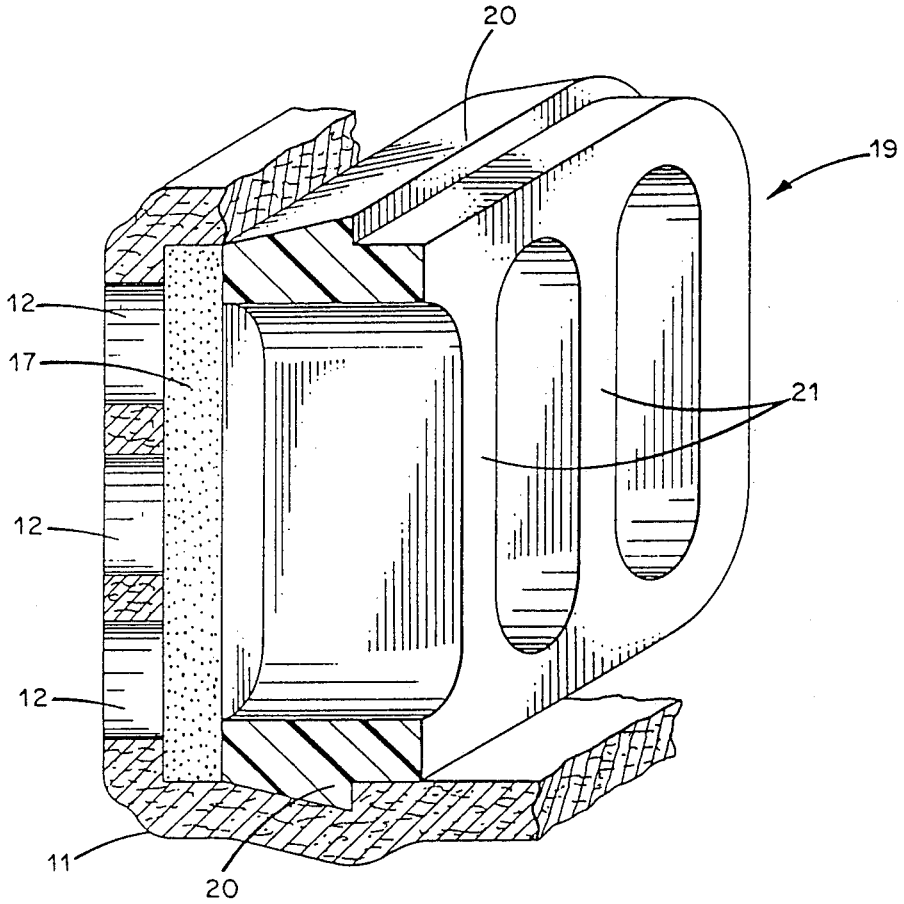
FIG. 4 is an isometric sectional view of a snap-in plastic retainer used for holding a filter media liner inside a mask that has only a filter mounted internally.

Although not specifically shown in FIG. 1, but shown in FIG. 3, there is a filter liner 17 mounted in the interior of mask shell 11 behind all of holes 12 to filter inhaled air passing through holes 12. As described in detail further in this specification internal filter liner 17 may also be retained inside of mask shell 11 by a snap-in retainer (not shown) which is shown in FIGS. 3 and 4 to produce a reusable mask 10. With a reusable face mask the filters may be periodically changed to continued the use in the same environment, or changed to a new type of filter for use in new environment. However, the snap-in retainer may be dispensed with and filter liner 17 may be permanently fastened inside of mask shell 11 by thermobonding or adhesives in a manner well known in the art to produce a disposable face mask that is used only once and then discarded.

When wearing face mask 10 shown in FIG. 1, mask shell 11 is flexible enough and is shaped so that it easily conforms to the contours of a wearer's face around the nose and mouth and deformation of the wearer's face is not required to achieve a good seal. In addition, rim 15 is soft enough that it fits very comfortably to the face of the wearer, generally with less force than prior art disposable masks that are stiff because of how they are fabricated. Accordingly, face mask 10 may be comfortably worn for long periods of time.

Figure 2:
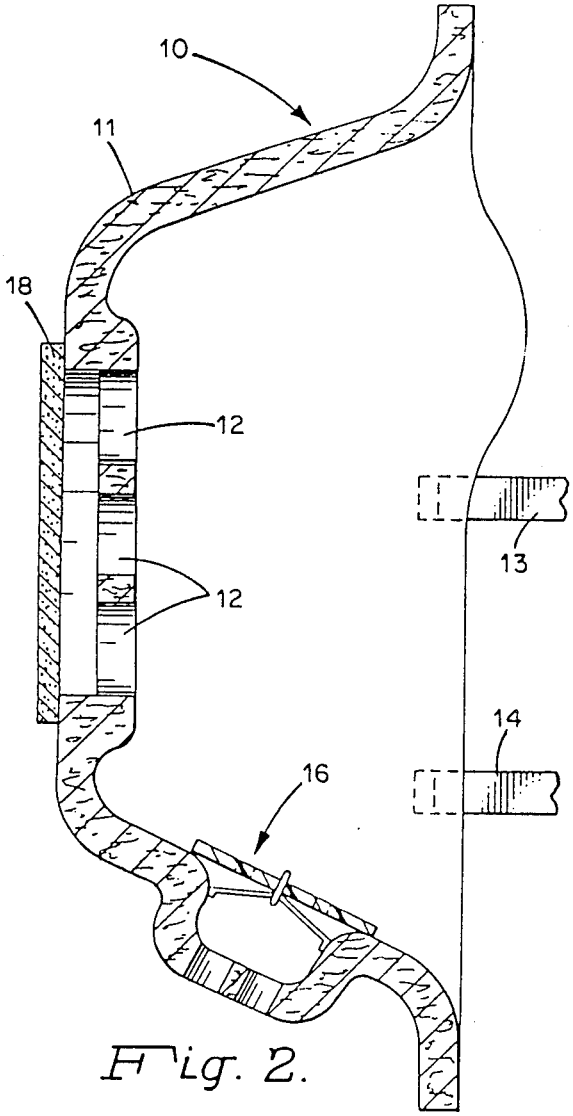
FIG. 2 is a side cross-sectional view of a mask having a filter attached to the front of the mask, showing the exhaled air exhaust valve, and the elastic straps that hold the mask to the face of a wearer.

In FIG. 2 is shown a side cross-sectional view of a face mask 10 with an external filter liner 18 mounted thereon. This mask also comprises an outer shell 11 which is thermoformed from a single-layer sheet of cross-linked, closed-cell foam that is impermeable to air, and exhaust valve 16. Mask 10 also has holes 12 through the front of foam mask shell 11. In a disposable version of mask 10 external filter liner 18 is fastened over holes 12 by thermobonding or by adhesives to create a disposable mask. However, external filter liner 18 may also be removably attached to the outside of mask shell 11 by a retainer arrangement such as shown and described hereinafter with reference to FIG. 5 to create a reusable face mask. With a reusable face mask the filters may be periodically changed to continue the use in the same environment, or changed to a new type of filter for use in a new environment.

Figure 4A:
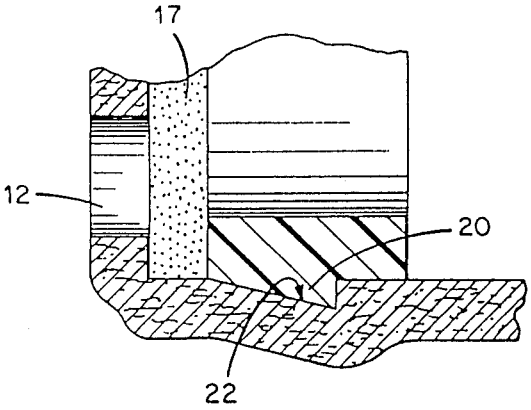
FIG. 4A is a cross sectional view of the mask shell showing the snap-in retainer of FIG. 4 in position inside the mask shell.
Figure 6:
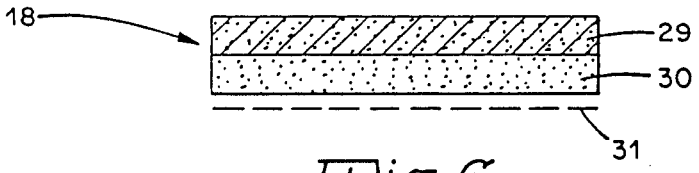
FIG. 6 is a view of a filter liner showing different layers thereof.

In FIG. 3 is shown a side cross sectional view of face mask 10. One-way exhaust valve 16 is seen mounted through the wall of the lower portion of mask shell 11 where it does not interfere with filter liner 17. Filter liner 17 may be permanently fastened inside of mask shell 11 over holes 12 by thermobonding or by adhesives for a disposable mask, or filter liner 17 may be detachably fastened inside of mask shell 11 over holes 12 by a snap-in retainer 19 as shown to create a reusable mask. Further details of retainer 19 are shown in FIG. 4, and further details of how retainer 19 holds replaceable liner 17 inside of mask shell 11 by being held in a molded recess around the inner wall of the shell 11 are shown in FIG. 4*a*. The construction of an exemplary multilayer filter liner 17 is shown in FIG. 6. Basically, internal filter liner 17 is prefabricated with one or more than one layer and then is stamped out in flat rectangular or other shape pieces. In a multilayer version of filter liner 17 there is a first layer (not shown) of a fibrous material impregnated with activated charcoal. There is also a second layer (not shown) that is attached to the activated charcoal layer. The second layer is preferably a net layer for appearance purposes. Filter liner 17 fits in the middle of the inside of mask shell 11 covering all of holes 12. Due to the flexibility of liner 17 it readily conforms to the inside of the central portion of mask shell 11.

In FIG. 4 is shown isometric sectional view of snap-in retainer 19. Retainer 19 is molded of a flexible thermoplastic material that can bend as it is inserted into the interior of mask shell 11 and is held in a groove therein as shown in detail in FIG. 4*a*. The plastic from which retainer 19 is molded is also tough, and coupled with the thickness of the retainer it does not break easily. The outer edges 20 snap into the aforementioned groove around the interior of mask shell 11 to retain filter liner 17 inside mask shell 11. On assembly into face mask 10 retainer 19 also deforms to match the contour of the inside of mask shell 11. There are also ribs 21 that help hold internal filter liner 17 against the inner surface of mask shell 11 over holes 12. Ribs 21 have much space between them so they do not materially impede the flow of inhaled air passing through filter liner 17 to the inside of mask 10. It should be appreciated that there may be many designs of retainer 19 that will work with the mask. When it is desired to replace filter liner 17, retainer 19 is grasped near one edge and pulled, removing the retainer from the inside of mask shell 11. The spent filter liner 17 is then removed and replaced with a new filter liner 17, and retainer 19 is then reinstalled.

In FIG. 4*a* is a cross sectional view of mask shell 11 that shows groove 22 that is formed around the inside of shell 11 during thermoforming. Retaining 19 is shown in its snapped-in position with its outer edges 20 in a force fit engagement in groove 22. It can be seen that on insertion retainer 19 deforms to hold filter liner 17 inside of mask shell 11 up against holes 12. This force fit engagement maintains a good seal so that no inhaled air passes around filter liner 17.

While the description of FIGS. 1 through 3 has been for masks in which the filter liner 17 may be removed and be replaced, the retaining means 19 may be eliminated and filter liner 17 may be thermobonded or adhesively bonded to the inside and-or the outside of mask shell 11. This makes a disposable face mask 10 that is replaced after a single use.

The interior view of mask 10 shown in FIG. 3 is for a version of the mask wherein there is only the interior filter liner 17. With this version snap-in retainer 19 is used. When a version of mask 10 has both an interior filter liner 17 (FIG. 1) and an exterior filter liner 18 (FIG. 2), different filter retainer means may be utilized. This different retainer means is retainer means 23 shown in FIG. 5. Retainer means 23 jointly holds both interior filter liner 17 and external filter liner 18 at the same time. Retainer 23 comprises pieces 24 through 27 that are molded out of a thermoplastic, or are made out of metal. Piece 24 is a rectangular, or other suitable shape, frame having a number of central area holes or rib pieces alike snap-in retainer 19 and that serve the same purpose, and having a number of protrusions 25 around its edge as shown. Piece 26 is another rectangular, or other suitable shape, frame having the same dimensions as frame 24 and may also have holes or rib elements but having number of holes 27 therethrough instead of protrusions 25. The holes 27 are located around the edge of frame piece 26 in exact registration with protrusions 25 around the edge of frame piece 24. In manufacture mask shell 11 has a number of holes 28 made therethrough that are equal in number to the number of protrusions 25 and are of the same diameter as holes 27. These extra holes 28 through mask shell 11 surround holes 12 through which inhaled air passes. The outer dimensions of the edges of filter liners 17 and 18 are such that they just fit within protrusions 25. Alternatively, filter liners 17 and 18 may have the same outer edge dimensions as frame pieces 24 and 26. When this is the case there are a number of holes (not shown) through filter liners 17 and 18 around their edges. The diameter of these holes is the same as holes 27 and they are in the same positions.

Figure 5:
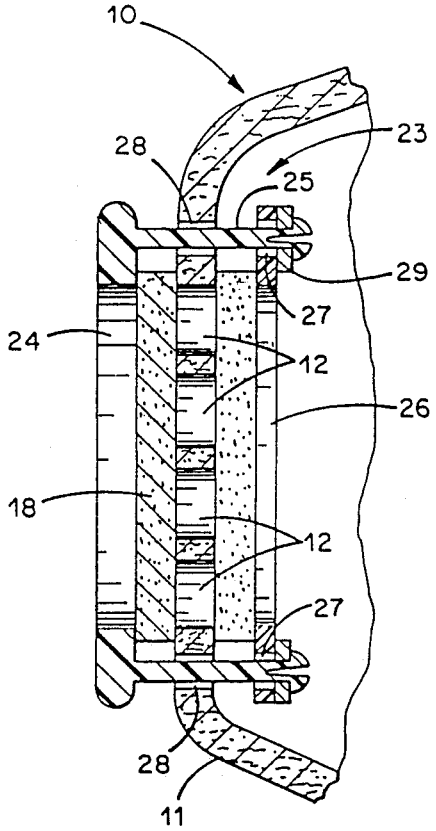
FIG. 5 shows a filter retainer arrangement used with a mask that has both an external pre-filter and an internal post-filter.

On assembly of filter retainer 23 to mask shell 11 with filter liners that have no holes through them, external filter liner 18 is laid on the ribs of frame piece 24 between protrusions 25. The protrusions 25 are then inserted from the front of mask 10 through the corresponding holes around the holes 12 to the inside of mask shell 11. Frame piece 26 is then placed in the inside of mask shell 11 so that the portions of protrusions 25 extending to the inside of mask shell 11 pass through its holes 27. Retainer clips 29 are then placed on each protrusion 25 and pressed on to pinch mask shell 11 and filter liners 17 and 18 between frame pieces 24 and 26 as shown in FIG. 5. The ribs of frame pieces 24 and 26 hold filter liners 17 and 18 up against holes 12 through which inhaled air passes.

When filter liners 17 and 18 have holes around their periphery external filter liner 18 is first assembled to frame piece 24 so that protrusions 25 pass through the holes. After frame piece 24 is assembled to mask shell 11 as described in the last paragraph, the inner filter liner 17 is assembled so the protrusions 25 pass through the holes around its periphery. The frame piece 26 and clips 29 are assembled as described in the last paragraph. It would be obvious that one skilled in the art can devise many different ways of jointly retaining inner and outer filter liner 17 and 18 to mask shell 11 so that inhaled air cannot pass around the edges of the liners.

In FIG. 6 is shown an exemplary filter liner 17 or 18 that is a multilayer filter liner. This exemplary multilayer filter liner has a first layer 29 of a fibrous material used for filtering dust and mist form inhaled air. The second layer 30 is a fibrous material that is impregnated with activated charcoal or other chemicals for absorbing noxious or poisonous gasses and mists and airborne particulate matter. Such a material is available from Extraction Systems, Norwood, Mass. A net like material forms the third layer 31. Layer 31 is that layer of inner filter liner 17 which faces the inside of mask shell 11, or is that layer of filter liner 18 that is seen on the outside of mask 10 and are provide for aesthetic appearance only. Layer 31 may be "Delnet", a non-woven, poruous net material manufactured by the Hercules Corporation.

Figure 7:
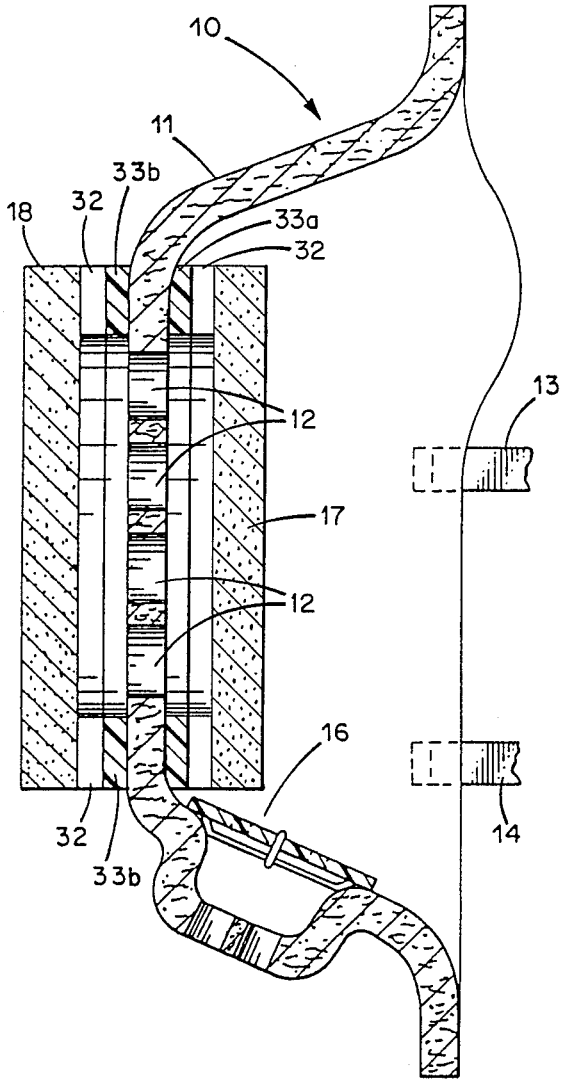
FIG. 7 is a cross-sectional view of a foam shell mask having only one filter which is replaceably mounted on the outside of the mask by means of a self adhesive strip.

In FIG. 7 is shown the preferred embodiment of the invention in which the snap-in retainer 19 or combination retainer 23 previously described are not utilized. Rather, provision is made to removably attach both an external filter liner 18 by means of a self adhesive strip 32 attahced to the edge of the liner and an internal filter liner 17 by means of a self adhesive strip attached to the edge of liner 17. To implement this embodiment a flat, rectangular, oval or other plastic mounting piece 33 is attached to the front of mask pieces **33*a* and 33*b* shell 11 as shown in FIG. 7. Mounting piece 33 is made of rigid plastic and comprises an inner mounting piece 33*a* and outer mounting piece 33*b* which connect together and cover holes 12. The purpose of mounting is to provide a base to which a self adhesive filter liners 17 and 18 may be attached. Mounting pieces 33*a* and 33*b* surrounds holes 12 through which inhaled air passes and it may be attached by thermobonding, adhesive bonding or by some other technique. The wearer of mask 10 takes a replacement external filter liner 18 that has a self adhesive strip fastened around the edge thereof and peels off an easy release protective cover strip (not shown) that is well known in the pressure sensitive self adhesive art. Filter liner 18 is then placed on mounting piece 33*b* so that the self adhesive strip fastens filter liner 18 thereto. When it is time to replace filter liner 18 the edge thereof is grasped and it is peeled from mounting piece 33. A new self adhesive filter liner 18 is then affixed to mounting piece 33*b* . In addition invention mounting piece 33*a* fastened to the inside of foam mask shell 11 and self adhesive filter liner 17** is attached thereto inside of the mask rather than on the outside.

Where needed, self adhesive filter liners 17 and 18 may be attached to both mounting pieces **33*a* and 33*b*. In this manner mask 10** may be used to provide filtering against selective combinations of noxious and poisonous gasses, dusts and mists.

In an alternative embodiment filter liners 17 and/or 18 may be substituted with a filter cartridge of types known in the art. In yet another embodiment filter liners 17 and/or 18 may be permanently and directly mounted against foam mask shell 11 covering all holes 12 by a variety of techniques well known in the art.

Figure 8:
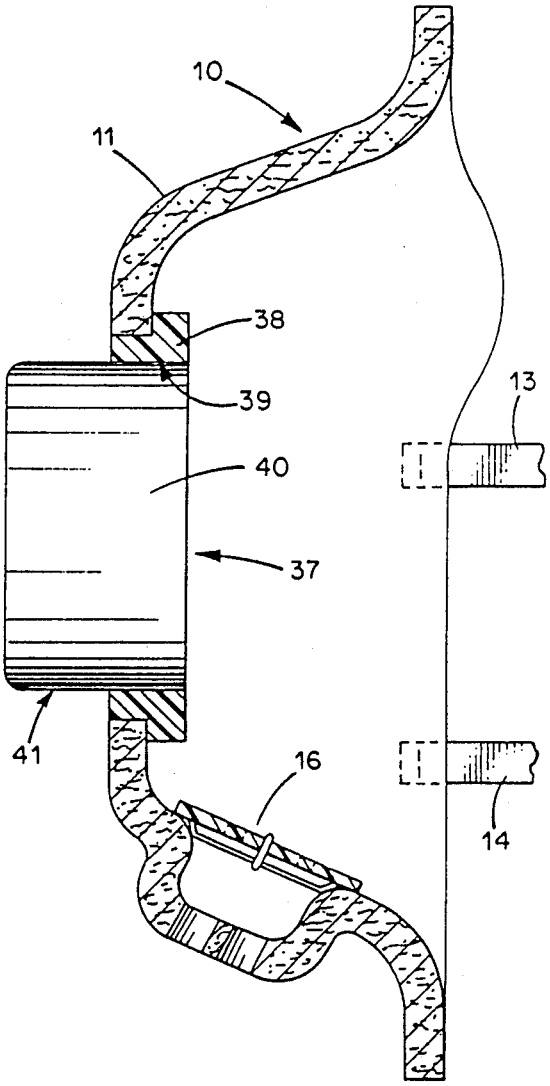
FIG. 8 is a cross-sectional view of a foam shell mask that utilizes one or more filter cartridges detachably fastened to collars that mount through and are fastened to the foam shell in lieu of filter liners.

In FIG. 8 is shown another alternative embodiment of the invention that has a foam mask shell 11 but which does not utilize filter liners as previously described. The air passage holes 12 also are not punched through foam mask shell 11. Rather, at least one larger hole 37 is punched through shell 11 and a collar 38 is thermobonded, friction snap-fit or adhesive bonded through the wall of mask shell 11 in hole 37. Alternatively, large hole 37 may be substituted with a permeable formed cavity suitably shaped to accept a filter cartridge. For example by having a plurality of holes for flow of air therethrough. Walls of such a formed cavity may have a straight or a corrugated (bellows like) shape. Alternatively, there may be two holes or cavities 37 and two collars 38, but only one is shown in FIG. 8 for ease of representation. Collar 38 may be of cylindrical or other shape and a passage or hole 39 through it is used to mount a replaceable cartridge filter 40 of the type well known in the art. Cartridge filter 40 has an extension 41 having, in essence, an outside dimension approximately equal to the inside dimension of the cylindrical passage 39 through collar 38. To mount cartridge filter 40 its extension 41 is inserted into passage 39 where it makes a relatively tight friction fit that retains filter 40 therein. In addition, no unfiltered air can pass through this joint. To replace a cartridge filter 40 it is grasped and twisted back and forth while pulling it away from mask shell 11. When it is removed a new filter cartridge 40 is installed. There are many different types of filter cartridges that may be interchanged to use mask 10 in FIG. 8 in many types of environments. Alternatively, filter cartridge 40 may be attached to mask shell 11 in a permanent manner by a variety of methods well known in the art. This foam shell mask is then a replacement for the more conventional type of "gas mask" except that it is less expensive, much lighter and is more comfortable to wear. Being less expensive, such masks will not be shared with the attendant problems of mask care and communicable disease concerns described in the Summary of the Invention.

Figure 9:
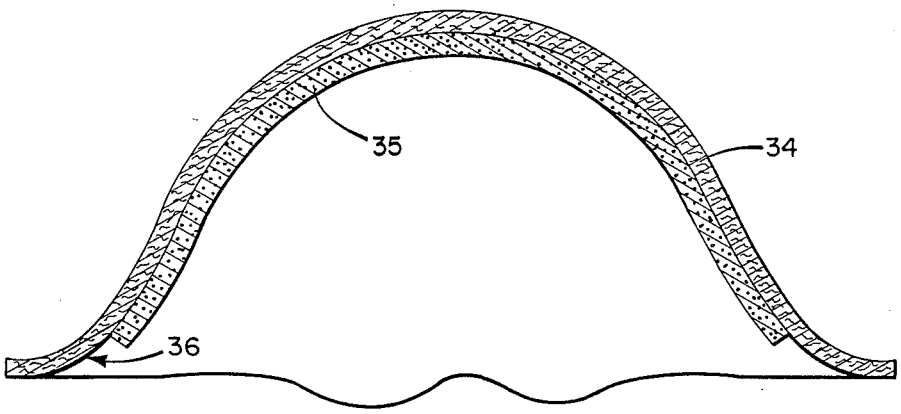
FIG. 9 shows a cross-sectional view of a fibrous shell mask in which a post-filter liner is bonded during manufacture.

In FIG. 9 is shown a cross sectional view of another alternative embodiment of the invention. An outer mask shell 34 is fabricated by thermoforming a sheet of synthetic fiber, woven, knitted or nonwoven, filter material in a cup-shape. One such filter material is marketed under the registered trademark VILEDON MICRODON by the Carl Freudenberg Company of Germany and marketed in the United States by Pellon Corporation of Lowell, Mass. When thermoformed into mask shell 34 the filter material is permanently set and retains its molded shape. Before or after thermoforming, a piece of sheet fibrous liner material 35 that is impregnated with activated charcoal is placed against (shown in FIG. 9 inside) the material of the mask shell 34 but not covering the edge or rim 36 that touches the face of the wearer. Through coating, fusion of fibers, or use of impermeable foam or other laminates, rim 36 is rendered impermeable to flow of air, thus localizing flow of all breathed air only through the area of shell 34 covered by liner 35. The two sheets 34 and 35 may be assembled together in a variety of manners well known in the art. Alternatively, liner 35 may be made of other materials and may comprise more than one layer for functional, assembly and/or aesthetic purposes. One mask shell that may be used as mask shell 34 to which filter liner 35 may be assembled is taught in U.S. Pat. No. 4,641,645 assigned to the same assignee as this patent.

While what has been described hereinabove are the preferred embodiments of the invention, it will be obvious to those skilled in the art that numerous changes may be made without departing from the spirit and scope of the invention. For example elastic straps 13 and 14 may be attached to mask shell 11 by passing them through holes in rim 15 of the mask.

What is claimed is:

1. A face mask for filtering air comprising;

a unitary mask shell formed of a flexible, air impermeable, foam that has physical properties that provide shape retention to said mask shell, said mask shell having a least one hole through the central portion thereof, and elasticity that enables the edge of said unitary mask shell to conform and seal to the face of a wearer around their nose and mouth;

a first mounting means separate from but fastened to said mask shell, said first mounting means being made from a rigid material said first mounting means having an opening that is in registration with said at least one hole; and a first filter liner for filtering the air passing through said holes, said first filter liner having an adhesive strip around its periphery, and said adhesive strip being used to fasten said first filter liner and said face mask by being adhesively fastened to said first mounting means, said filter liner not contacting the face of the wearer when the face mask is worn, and said first filter liner covering said at least one hole to thereby filter all inhaled air passing through said at least one hole.

2. The invention in accordance with claim 1 further comprising a one-way exhaust valve mounted through the wall of said mask shell in position that it is not covered by said first filter liner, said valve for venting exhaled air.

3. The invention in accordance with claim 2 further comprising at least one elastic strap attached to the edge of said mask shell and being used to hold the face mask over the nose and mouth of a mask wearer by passing around the head of the wearer.

4. The invention in accordance with claim 1 wherein said first mounting means is fastened to the exterior of said mask shell and further comprising;

a second mounting means separate from but fastened to the interior of said mask shell, said second mounting means being made from a rigid material and having an opening that is in registration with said at least one hole, a second filter liner for filtering the air passing through said at least one hole, said second filter liner having an adhesive strip around its periphery, and said adhesive strip being used to fasten said second filter liner to said face mask by being adhesively fastened to said second mounting means, said filter liner not contacting the face of the wearer when the face mask is worn, and said second filter liner covering said at least one hole to thereby filter all inhaled air passing therethrough, and said first filter liner and said second filter cooperate to filter all inhaled air.

5. The invention in accordance with claim 1 wherein said air impermeable foam material from which said face mask shell is fabricated is a laminate structure.

6. A face mask for filtering air comprising;

a unitary mask shell formed of a flexible, air impermeable, foam that has physical properties that provide shape retention to said mask shell, said mask shell having at least one hole through the central portion thereof, and elasticity that enables the edge of said unitary mask shell to conform and seal to the face of a wearer around their nose and mouth;

mounting means separate from but being attached to said mask shell, said mounting means having a first portion external to said mask shell and a second portion internal to said mask shell, said first and second portions of said mounting means being made from a rigid material and each having an opening that is in registration with said at least one hole;

a first filter liner having an adhesive strip around its periphery, said adhesive strip being used to adhesively fasten said first filter liner to said first portion of said mounting means external to said mask shell, said first filter liner not contacting the face of the wearer when the face mask is worn;

a second filter liner havng an adhesive strip around its periphery, said adhesive strip being used to adhesively fasten said second filter liner to said second portion of said second mounting means internal to said mask shell, said second filter liner not contacting the face of the wearer when the face mask is worn; and said first and second filter liners covering said at least one hole to thereby filter all inhaled air passing through said at least one hole, and said first and second filter liners not contacting the face of the wearer when the face mask is worn.

* * * * *